US009038562B2

(12) United States Patent
Cassanas et al.

(10) Patent No.: US 9,038,562 B2
(45) Date of Patent: May 26, 2015

(54) SEMI-RIGID CRAFT, THE BUOYANCY OF WHICH IS ADJUSTABLE

(75) Inventors: Marc Cassanas, Figueres (ES); Erle Dumontier, Paris (FR); Lionel Boudeau, Paris (FR)

(73) Assignee: ZODIAC MILPRO INTERNATIONAL, Paris (FR)

( * ) Notice: Subject to any disclaimer, the term of this patent is extended or adjusted under 35 U.S.C. 154(b) by 350 days.

(21) Appl. No.: 13/703,470

(22) PCT Filed: Jun. 15, 2011

(86) PCT No.: PCT/FR2011/051349

§ 371 (c)(1),
(2), (4) Date: Feb. 6, 2013

(87) PCT Pub. No.: WO2011/157944

PCT Pub. Date: Dec. 22, 2011

(65) Prior Publication Data

US 2013/0305979 A1 Nov. 21, 2013

(30) Foreign Application Priority Data

Jun. 17, 2010 (FR) ..... 10 54801

(51) Int. Cl.

| | |
|---|---|
| ***B63B 7/08*** | (2006.01) |
| ***B63B 11/04*** | (2006.01) |
| ***B63B 27/08*** | (2006.01) |
| ***B63B 35/42*** | (2006.01) |
| ***B63G 8/14*** | (2006.01) |
| *B63B 7/06* | (2006.01) |

(52) U.S. Cl.

CPC ..... *B63B 7/082* (2013.01); *B63B 35/42* (2013.01); *B63B 2007/065* (2013.01); *B63B 7/08* (2013.01); *B63B 11/04* (2013.01); *B63G 8/14* (2013.01)

(58) Field of Classification Search

CPC ..... B63B 7/06; B63B 2007/065; B63B 7/08; B63B 7/082; B63B 7/085; B63B 7/087; B63B 11/04; B63B 27/00; B63B 27/08; B63B 27/36; B63B 35/42; B63G 8/14; B63G 8/22

USPC ..... 114/121, 125, 312, 331, 333, 345; 441/40–42

See application file for complete search history.

(56) References Cited

U.S. PATENT DOCUMENTS

| | | | | |
|---|---|---|---|---|
| 3,559,222 | A * | 2/1971 | Walker | 114/357 |
| 5,228,407 | A * | 7/1993 | Cummer et al. | 114/345 |
| 7,000,562 | B2 | 2/2006 | Bouquard | |

FOREIGN PATENT DOCUMENTS

| | | |
|---|---|---|
| DE | 7245860 U | 3/1973 |
| DE | 2805647 A1 | 9/1979 |

(Continued)

OTHER PUBLICATIONS

International Search Report, dated Nov. 11, 2011, from corresponding PCT application.

*Primary Examiner* — Ajay Vasudeva

(74) *Attorney, Agent, or Firm* — Young & Thompson

(57) ABSTRACT

A craft includes a rigid hull (1) that consists of a V-shaped bottom (5) and a bridge (4) on which a load can rest. The hull includes plating consisting of compartmentalized pneumatic floats (2), the rear compartments (32) of which are combined with an inflation and deflation system so as to vary the buoyancy of the craft. The craft also includes a submergible hull (1), the central cavity (9) of which is formed between the bottom (5) and the bridge (4) and is open at the rear so as to be automatically filled or emptied, the central cavity (9) containing at least one bag (10) that is combined with an inflation and deflation system enabling the buoyancy to be varied and consequently the level of immersion of the stern (7) to be changed as needed.

11 Claims, 3 Drawing Sheets

(56) References Cited

FOREIGN PATENT DOCUMENTS

| | | | |
|---|---|---|---|
| FR | 2863579 | A1 | 6/2005 |
| GB | 1350208 | A | 4/1974 |
| GB | 2208158 | A | 3/1989 |
| WO | 2005054047 | A2 | 6/2005 |

* cited by examiner

SEMI-RIGID CRAFT, THE BUOYANCY OF WHICH IS ADJUSTABLE

FIELD OF THE INVENTION

The invention relates to a semi-rigid craft, meaning a craft comprising a rigid hull, and upper side walls (also referred to herein as plating) and a bow which consist of pneumatic floats in the form of an inflatable tube.

More specifically, the invention relates to a craft arranged for transporting floating loads such as, for example, floating tanks, marker buoys, small craft, etc., and for collecting these same floating loads directly from the water, in a marine environment.

BACKGROUND OF THE INVENTION

Such a craft, which acts as a small floating dock, is described in document FR 2 863 579.

As described in this document, the craft comprises a ballast arranged in the rear part of the rigid hull. This ballast is associated with pumping means for filling and emptying it as needed.

Filling the ballast with water has the effect of modifying the weight of the hull and therefore submerging said hull as desired, particularly its stern.

To allow introducing a load into the craft, and subsequently releasing it if applicable, the hull does not have a transom. Its stern is open, and loads are moved on its deck using a winch.

In fact, this craft is a simple sled which is moved by another, motorized, craft.

As described in the above document, filling the ballast with water submerges the stern of the craft, and it can be submerged to a greater or lesser extent depending on the type of load to be collected from or placed in the water.

To increase the amount by which the stern is submerged, or in other words to lower the level of the deck, this document FR 2 863 579 also specifies deactivating the rear chambers of the side floats by deflating them.

These two rear chambers can be deflated by means of a valve system. Each chamber is connected to a three-way valve which allows deflating and reinflating it using one or more bottles containing compressed air, such as diving cylinders.

The above document specifies using an electric pump to empty and fill the ballast, and therefore having a battery on board in order to power this pump.

Considering the conditions for using this type of craft, such pumping equipment imposes preparation and maintenance constraints if a reliable and efficient operation is to be ensured under all circumstances.

SUMMARY OF THE INVENTION

The invention proposes a novel arrangement of the craft, and in particular of the rigid hull, which obtains a ballast effect with relatively simple means and without having to use a pumping system of the type described in the above document.

The semi-rigid craft of the invention therefore comprises a rigid hull consisting of a bottom and a deck, also referred to herein as a bridge or floor, on which a load can rest and which is accessible from the rear at a level which corresponds to the level of said deck, said craft comprising upper side walls consisting of pneumatic floats which join together at the bow, said floats being compartmentalized and the rear compartments at the stern being associated with inflation and deflation means in the form of three-way valves so as to vary the buoyancy of the craft, said craft comprising a submergible hull of which the central cavity, formed between the bottom and the deck, is open at the rear in order to be filled and emptied automatically, said central cavity extending from the stern for most of the length of the hull and containing at least one inflatable bag, said bag being associated with inflation and deflation means enabling the buoyancy to be varied and consequently the level of immersion of said stern to be changed as needed, said central cavity of the rigid hull being completely open at its rear part to allow introducing the inflatable bag or bags as well as introducing or draining water, and its front part being open by means of at least one opening made in the deck to allow the passage of air, particularly during inflation of the bag or bags.

In another arrangement of the invention, the hull comprises a transverse bulkhead in its front part, to delimit the central cavity, which is substantially located at ¾ of the length of the hull away from the stern.

Still according to the invention, the central cavity is delimited on the sides by longitudinal bulkheads in the form of ribs which act as reinforcements between the deck and the bottom.

In another arrangement of the invention, the bag comprises anchoring means arranged in its front part and its rear part, respectively cooperating with the transverse bulkhead and with the deck, or the side bulkheads, at their rear part.

Still according to the invention, the inflatable bag comprises tubing in its front part, connected to a three-way valve, said valve being connected to a reserve of compressed air in the form of a diving cylinder, for inflating said bag and ensuring the buoyancy of the craft, or for deflating it by releasing air in order to submerge the stern of said hull. If there are several bags, each bag can be supplied air separately.

In another arrangement of the invention, the front part of the craft, in the rigid hull, comprises a cavity arranged in front of the transverse bulkhead, said front cavity being filled with a product such as very low density foam to form a reserve buoyancy chamber.

Still according to the invention, the opening, or if applicable each opening, arranged in the deck at the front of the central cavity is protected by a grid allowing the passage of air and water, said grid being removable to allow access to the front part of the corresponding inflatable bag.

In another arrangement of the invention, the side cavities arranged on each side of the central cavity containing the inflatable bag, are also open in the back, at the stern, and they are each equipped with an opening arranged at the front, made in the deck.

Still according to the invention, the deck comprises towing guides in its rear part, between the pneumatic floats, said guides being arranged vertically so as to center the load as it is introduced onto the deck, said introduction occurring by means of a winch arranged at the front of said deck and integrally attached to the deck.

In another arrangement of the invention, the deck comprises a pad or roller type of device at its back end to facilitate the introduction of the load, arranged transversely, before the edge of said deck.

Still according to the invention, the various inflation and deflation valves, which are three-way valves, are grouped on an arch structure arranged at the front of the deck, said arch also comprising means for attaching the bottles of compressed air used to inflate the compartments of the rear side floats.

BRIEF DESCRIPTION OF THE DRAWINGS

The invention is described below in a sufficiently clear and complete manner to enable its implementation, and the description is also accompanied by drawings in which.

DETAILED DESCRIPTION OF THE INVENTION

Figure 1:
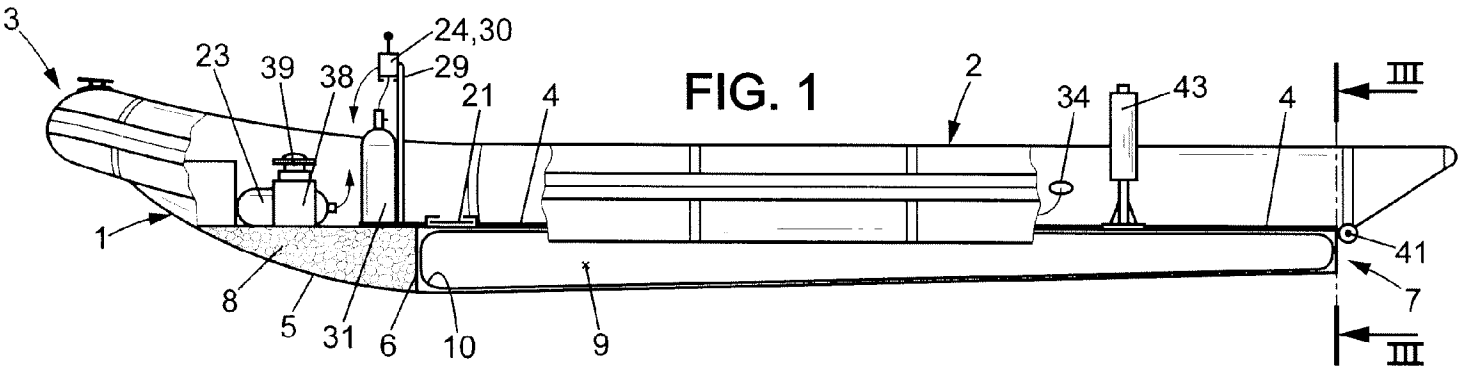
FIG. 1 is a side view of the craft of the invention, with parts of the pneumatic float cut away to show the equipment installed on the deck and with a cross-section of the hull showing the inflatable bag inserted in the longitudinal cavity and the reserve buoyancy chamber arranged at the front.

As represented in FIG. 1, the craft comprises a rigid hull 1 made of a single piece of composite material, and pneumatic floats 2 which form the upper side walls and join together in front at the bow 3. These floats 2 are fastened to the hull by appropriate means.

The hull 1 consists of a deck 4, or floor or bridge, and a V-shaped bottom 5. This bottom 5 and the deck 4 delimit a space which extends for the entire length of the hull 1. This space is divided by a vertical bulkhead 6 which extends transversely and is positioned at about ¾ of the length of the hull 1 away from the stern 7.

The cavity 8 located in front of the bulkhead 6 constitutes a reserve buoyancy chamber. It is, for example, filled with a very low density foam.

The longitudinal cavity 9, located behind the bulkhead 6, encloses a bag 10 in the form of an inflatable tube or balloon. This bag 10 allows modifying the buoyancy of the craft as desired; it is made of the same type of flexible fabric that is used to produce the floats 2.

The longitudinal cavity 9 is completely open at the back, at the stern 7, so that the hull is submergible. This opening at the back also allows automatically emptying this cavity 9 when the craft is towed at a certain speed in reduced functionality mode, meaning when the bag 10 is deflated after an incident.

Depending on the dimensions of the craft and the shape of the hull 1, the bag 10 may occupy the entire space behind the transverse bulkhead 6, between the deck 4 and the bottom 5.

Figure 3:
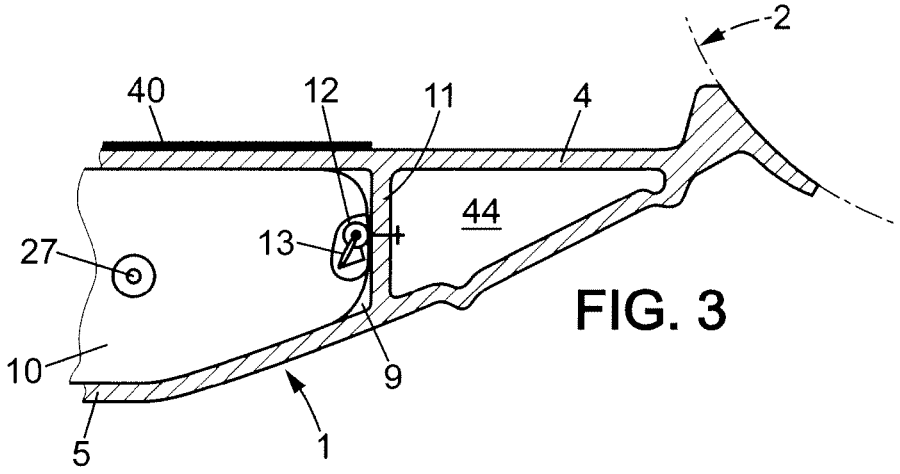
FIG. 3 is a transverse half-section view of the rigid hull of this craft, showing the central cavity which houses the inflatable bag, and showing one of the side cavities which is either empty or is also filled, depending on requirements, with an inflatable bag.

In the example embodiment shown in FIG. 3, the space between the bottom 5 and the deck 4 is divided into several parts which form longitudinal cavities behind the transverse bulkhead 6; these different cavities can each accept an inflatable bag if required.

Cavity 9 is located at the center of the craft and is delimited, as represented in FIG. 3, by the bottom 5 and the deck 4 as well as by longitudinal bulkheads 11, or side plates, which also act as ribs to reinforce the structure of the hull 1.

The inflatable bag 10 is fashioned so that in its inflated state it fills the entire volume of this central cavity 9, said volume being, for example, about 1000 liters.

The rear part of this bag 10 is attached at the stern 7 to the longitudinal bulkheads 11, by means of a ring 12 integrally attached to each bulkhead 11 and, for example, snap hooks 13 which laterally attach to the back end of said bag 10.

Figure 4:
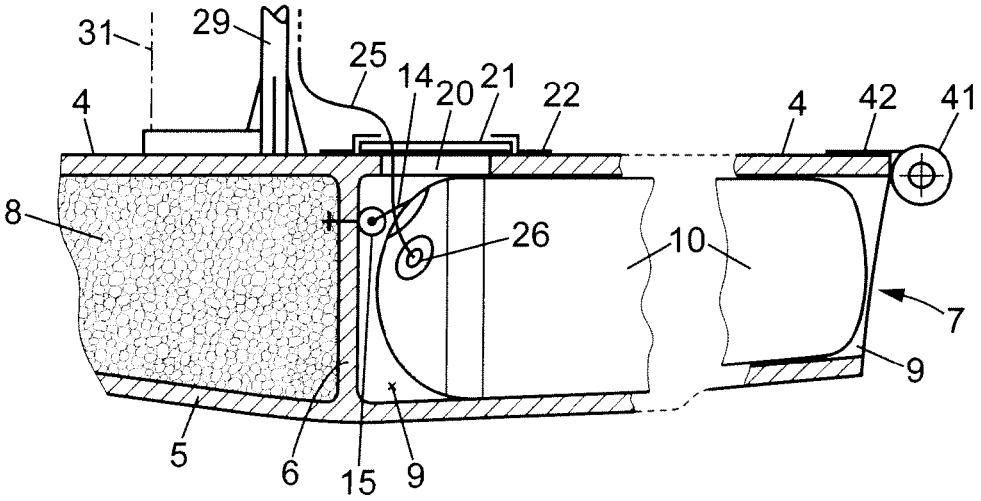
FIG. 4 illustrates part of a longitudinal cross-section of the rigid hull, showing the front end and rear end of the inflatable bag.

At its front part, as represented in FIG. 4, the bag 10 also comprises a snap hook 14 which cooperates with a ring 15 fixed to the transverse bulkhead 6, in order to secure this front part of the bag 10.

This bag 10, in the deflated state, is for example introduced into the longitudinal cavity 9 by means of a rope, not represented. This rope passes through the central cavity 9 and exits a hole 20 arranged at the front end of this central cavity 9, through the deck 4.

This hole 20 arranged in the deck 4 provides access to the front end of the bag 10 in order to anchor it to the ring 15.

This hole 20 also forms a vent; it is covered and protected by a grid 21 with openings that allow the passage of air and water during the inflation of the bag 10. This grid 21 is, for example, guided transversely in slide rails 22 arranged transversely on the deck 4 of the craft.

Figure 5:
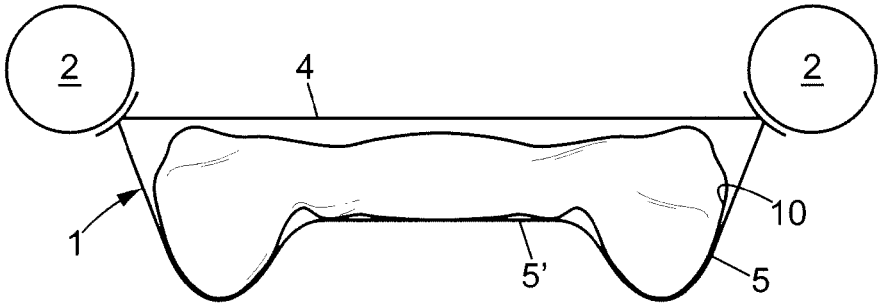
FIG. 5 illustrates a transverse cross-section of a hull in which the bottom comprises a flat central portion delimited by V-shaped parts and the space contains an inflatable bag shown as it is being inflated.

FIG. 5 shows another hull shape, in which the bottom comprises a V shape along each side, separated by a flat central portion 5' parallel to the deck and at a distance from the deck in order to accommodate a bag 10 which can fill up the entire space between said deck 4 and the bottom.

Figure 6:
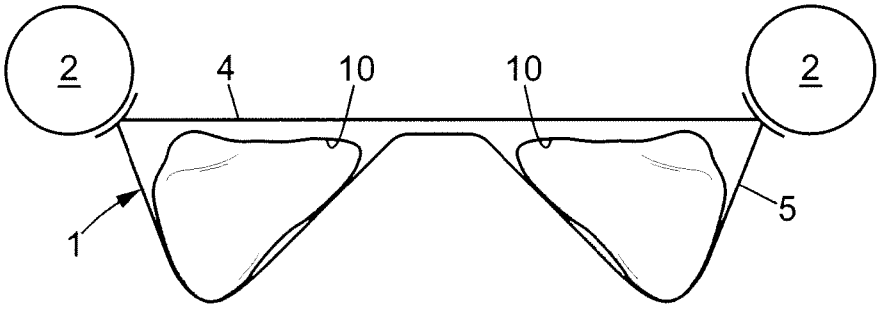
FIG. 6 shows a transverse cross-section of a catamaran style of bottom which houses two bags, said bags being shown slightly deflated.

FIG. 6 shows a variant embodiment with a catamaran style of hull 1, containing a bag 10 in each compartment of the bottom 5.

Figure 2:
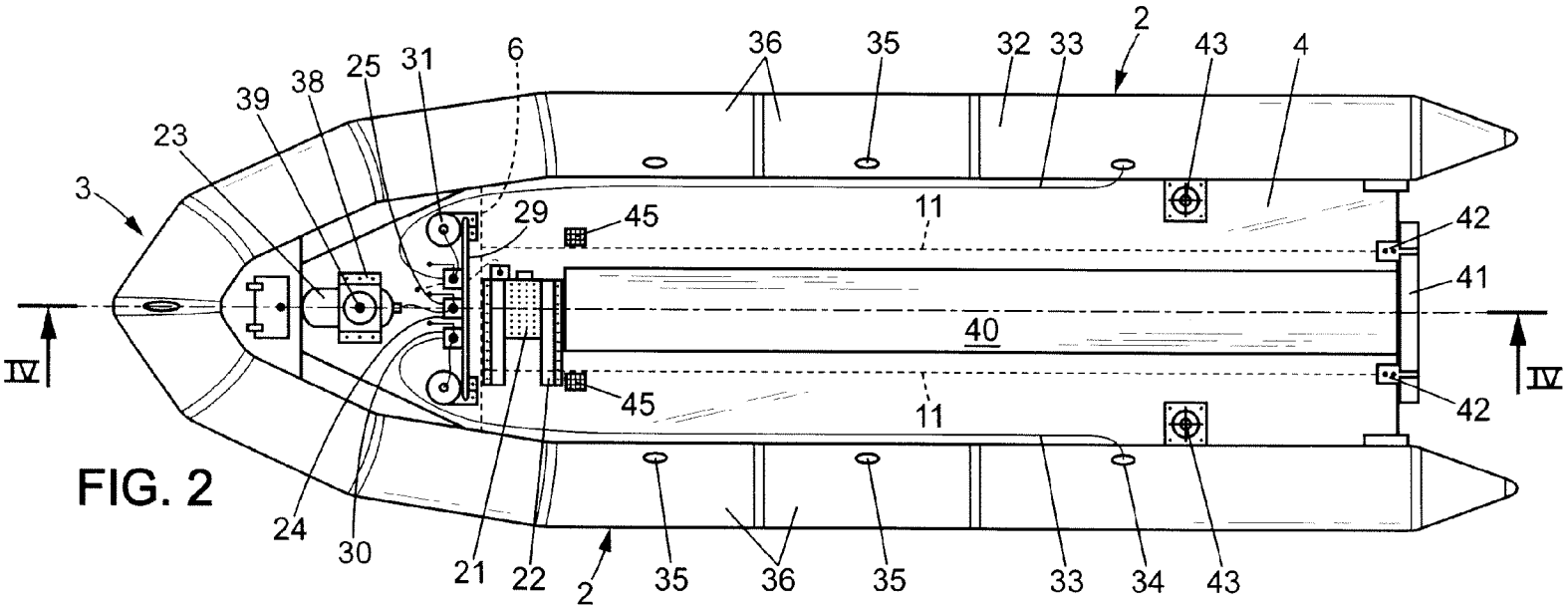
FIG. 2 is a plan view of this craft.

FIG. 2 is a view of the craft from above, showing the pneumatic floats 2 which form the upper side walls and join together in front at the bow 3.

On the deck 4 of the hull 1, the longitudinal bulkheads 11 and the transverse bulkhead 6 delimiting the central cavity 9 where the bag 10 is housed are represented with dotted lines.

Several openings 20 and grids 21 can be installed for accessing the various bags 10, as represented in FIG. 6.

Located at the front end of this central cavity 9 is the grid 21 which covers the opening 20 providing access to the front end of the bag 10.

In the front part of the craft, as represented in FIGS. 1 and 2, there are several bottles of compressed air, meaning diving cylinders, for example providing a capacity of about 15 liters.

One bottle 23 is housed at the front, placed lengthwise on the deck 4; this bottle 23 is connected to the bag 10 by means of a valve 24 and a pipe 25. The pipe 25 is attached to a fitting 26, visible in FIG. 4, which is located at the front of the bag 10 and which is accessible through the hatch 21.

The valve 24, which is a three-way valve, allows inflating and deflating the bag 10 as needed.

This bag 10 comprises a relief valve 27, for example in its rear part. This valve 27 allows limiting the pressure inside the bag 10 to a value which is, for example, on the order of 180 millibars, to avoid any risk of deformation to the rigid hull 1 during inflation of said bag 10.

This relief valve is found on the bags 10 of the embodiments represented in FIGS. 5 and 6. For the bag occupying the entire volume between the deck 4 and the bottom 5, in the embodiment of FIG. 5, this relief valve is adjusted for a sufficiently low pressure to avoid any risk of deformation to said hull.

The three-way valve 24 is, for example, installed on an arch 29 which is installed in the front part of the craft. This arch 29 can also support the other three-way valves 30 which are placed between the bottles 31 and the rear compartments 32 of the floats 2, said rear compartments being likely to be deflated as well in order to modify the level of immersion of the stern 7 of the craft as needed.

The bottles 31 used for inflating the side compartments 32 are arranged vertically, anchored to the vertical arms of the arch 29 which is in the form of an upside-down U. These bottles 31 are connected, by pipes 33, to fittings 34 on the compartments 32. The other compartments 35 of the side floats 2 can also be used when needed to submerge the stern of the craft to a greater or lesser extent; they comprise fittings 36 that can be connected to the pipes 33 for this purpose.

The bottle 23 is, for example, housed in a U-shaped structure 38 attached in an appropriate manner to the deck 4, said structure 38 covering the bottle 31 and serving as a support for a conventional winch 39, said winch 39 being provided for hauling a load onto the craft. This craft is accessible from the rear at a level which corresponds to the level of the deck 4. In fact, as represented in the figures, the craft is completely open at the back, without a transom.

The deck 4 of the craft may comprise, along its length and in its central part, a reinforcing strip 40 made of material appropriate for facilitating the sliding of the load.

The rear end of the deck 4 may also comprise means to facilitate positioning the load and in particular introducing it onto the craft. These means consist of devices 41 such as transverse pads or rollers placed at the edge of the deck 4. These rollers 41 are supported by bearings 42 anchored to the back of the deck 4.

To guide the load laterally, the rear part of the deck, between the floats 2, comprises towing guides 43. These guides 43 are arranged vertically; they consist of rollers which rotate on a vertical shaft.

The side cavities 44 arranged on each side of the central cavity 9 are, like the central cavity, completely open at their rear part and comprise openings or vents in their front part which are made in the deck, as represented in FIG. 2, or which can be made in front of the longitudinal bulkheads 11.

As represented in FIG. 2, the openings are covered by grids 45 which allow the passage of the air contained in these cavities as the stern of the craft is submerged.

In order to bring a floating load on board, the operator activates the deflation valve 24 of the bag 10, which has the effect of submerging the hull 1 of the craft by the stern which then fills with water in its central cavity 9 and side cavities 44. Depending on the required degree of immersion, the operator can also activate the deflation valves 30 of the rear compartments 32 arranged on the side floats 2.

After the load has been brought into place using the winch 39 located at the front, the operator, still by means of the three-way valves 30, reinflates the rear compartments 32 of the side floats 2 and also reinflates the bag 10; said bag forces out the water contained in the central cavity 9, which pushes the water towards the back of this cavity 9 and also towards the front through the opening 20 covered by the grid 21.

Once the reinflation is complete, the craft can be towed by a motorized craft.

The invention claimed is:

1. A semi-rigid craft having a bow and a stern and comprising a rigid hull consisting of a V-shaped bottom and a deck, on which a load can rest and which is accessible from the rear at a level which corresponds to a level of said deck, said craft comprising upper side walls consisting of pneumatic floats which join together at said bow, said floats being compartmentalized and rear float compartments at said stern being associated with inflation and deflation means in the form of three-way valves for varying the buoyancy of said craft, wherein said hull is a submergible hull, of which a central cavity, formed between said bottom and said deck, is open at the rear in order to be filled and emptied automatically, said central cavity extending from said stern for most of the length of said hull and containing at least one inflatable bag, said at least one inflatable bag being associated with inflation and deflation means enabling the buoyancy to be varied and consequently the level of immersion of said stern to be changed as needed, said central cavity of said hull being completely open at a rear part of said central cavity to allow introducing said at least one inflatable bag as well as introducing or draining water, and a front part of said central cavity being open by means of at least one opening made in said deck to allow the passage of air at least during inflation of said at least one bag.

2. The craft according to claim 1, wherein said hull comprises a transverse bulkhead in a hull front part, to delimit said central cavity, said transverse bulkhead being located substantially at ¾ of the length of said hull away from said stern.

3. The craft according to claim 2, wherein said central cavity is delimited on the sides by longitudinal bulkheads in the form of ribs which act as reinforcements between said deck and said bottom.

4. The craft according to claim 3, wherein said at least one inflatable bag comprises anchoring means arranged in a front part and a rear part of said at least one inflatable bag, respectively cooperating with said transverse bulkhead and with said longitudinal bulkheads, at a rear part thereof.

5. The craft according to claim 2, wherein a front part of said hull comprises a front cavity, arranged in front of said transverse bulkhead, said front cavity being filled with a product of low density to form a reserve buoyancy chamber.

6. The craft according to claim 2, comprising side cavities arranged on each side of said central cavity, and also open in the back, at said stern, and said side cavities are each equipped with a side opening arranged at the front, made in said deck, said side opening being hidden by a grid.

7. The craft according to claim 1, wherein said at least one inflatable bag comprises tubing in a front part of said at least one inflatable bag, connected to a three-way valve, which is connected to a reserve of compressed air in the form of a bottle, for inflating said at least one inflatable bag and ensuring the buoyancy of said hull, or for deflating said at least one inflatable bag by releasing air in order to submerge said stern of said hull.

8. The craft according to claim 7, wherein various inflation and deflation valves, which are three-way valves, are grouped on an arch structure arranged at a front of said deck, said arch structure also comprising means for attaching bottles of compressed air used to inflate compartments of side floats.

9. The craft according to claim 1, wherein said at least one opening arranged in said deck at the front of said central cavity is protected by a grid allowing the passage of air and water, said grid being removable to allow access to a front part of said at least one inflatable bag.

10. The craft according to claim 1, wherein said deck comprises towing guides in a rear part of said deck, between pneumatic floats, said towing guides being arranged vertically so as to center a load as the load is introduced onto said deck, said introduction occurring by means of a winch arranged at a front of said deck and integrally attached to said deck.

11. The craft according to claim 1, wherein said deck comprises a pad or roller type of device arranged transversely at a deck back end to facilitate an introduction of a load.

* * * * *